United States Patent [19]

O'Brien et al.

[11] Patent Number: 5,056,683

[45] Date of Patent: Oct. 15, 1991

[54] SLING STYLE GUM DISPENSER

[75] Inventors: Denise M. O'Brien, Flemington; Carlo P. Croce, Leonia, both of N.J.

[73] Assignee: Warner-Lambert Company, Morris Plains, N.J.

[21] Appl. No.: 440,938

[22] Filed: Nov. 22, 1989

[51] Int. Cl.[5] ..... B65D 83/00

[52] U.S. Cl. ..... 221/64; 221/185; 221/260; 221/312 R

[58] Field of Search ..... 221/260, 64, 65, 185, 221/268, 270, 279, 311, 312 R, 312 C, 255, 270, 276; 206/39.4, 254, 255, 258

[56] References Cited

U.S. PATENT DOCUMENTS

| | | | |
|---|---|---|---|
| 381,889 | 4/1888 | Scott | 206/254 |
| 695,914 | 3/1902 | Cressler | 221/260 |
| 1,566,445 | 12/1925 | Stringer | 221/260 |
| 2,027,645 | 1/1936 | Marx | 221/260 X |

FOREIGN PATENT DOCUMENTS

| | | | |
|---|---|---|---|
| 854560 | 10/1970 | Canada | 206/254 |
| 195806 | 8/1938 | Switzerland | 206/254 |

*Primary Examiner*—David H. Bollinger

*Attorney, Agent, or Firm*—Daniel A. Scola, Jr.; Richard S. Bullitt

[57] ABSTRACT

A cardboard stick gum dispenser comprises a rectangular-shaped container which has a slot formed on the lower part of its front panel. A paper sling extends from the upper part of the container's rear panel through the inside of the container to the slot. A free end of the sling extends from the slot and a stack of stick gum is supported on the sling inside the container. An individually wrapped stick of gum is drawn through the slot whenever the free end of the sling is pulled away from the container.

7 Claims, 1 Drawing Sheet

SLING STYLE GUM DISPENSER

FIELD OF THE INVENTION

The present invention relates generally to packaging for food and confectionary products. More particularly, the present invention relates to disposable gum dispensers which serve as both the commercial packaging for the gum and the gum dispensing mechanism. The present invention is particularly, but not exclusively, useful as a gum dispenser for stick gum.

BACKGROUND OF THE INVENTION

Chewing gum has been a satisfying pastime for many people for many years. In addition to the actual chewing of the gum, the play factor involved in obtaining the gum can also be entertaining for many. A good example of the play factor is the attraction which the familiar gum ball machines provide for younger people. Indeed, half the fun for some children seems to be in operating the gum ball machine to obtain the gum ball.

Unlike gum balls, stick gums have not been so widely identified with the so-called play factor. This is so, in part, because stick gums, unlike gum balls, require air-sealed packaging in order to stay fresh until shortly before they are to be chewed. Stick gums do not lend themselves to dispensing machines and, instead, it is preferable if the stick gum can remain in its original packaging as long as possible. Also, for several reasons, sticks of gum are normally stacked together. Thus, they are not as easily intermixed as are gum balls. Accordingly, stick gum dispensers need to address several unique considerations.

The present invention recognizes that the original packaging for a stack of stick gum can be also used as a disposable dispenser for the gum. Further, the present invention recognizes that a stick gum dispenser can be made which will enhance the play factor associated with obtaining a stick of gum from the package.

In light of the above, it is an object of the present invention to provide a stick gum dispenser which also serves as an effective packaging for keeping the gum fresh prior to its use Another object of the present invention is to provide a stick gum dispenser which enhances the play factor associated with the activity of chewing stick gum. Yet another object of the present invention is to provide a stick gum dispenser which is simple to use. Still another object of the present invention is to provide a stick gum dispenser which is relatively easy to manufacture, and comparatively cost effective as a packaging material.

SUMMARY OF THE INVENTION

The preferred embodiment of the stick gum dispenser of the present invention comprises a rectangular-shaped carton or container which has a front panel formed with a slot on its lower part. A rear panel is disposed opposite and substantially parallel to the front panel and is connected to the front panel by several intermediate panels which include a top panel, a bottom panel and a pair of mutually opposite side panels. With these panels in place, the container is configured as a hollow rectangular parallelepiped enclosing an interior compartment.

An elongated tape-like sling is connected to the upper part of the rear panel to extend through the interior compartment and out through the slot in the lower part of the front panel. The unconnected free end of the sling extends a sufficient distance through the slot to be grasped by a person desiring to obtain a stick of gum from the container. Inside the container, a stack of stick gum is supported on the sling such that whenever the free end of the sling is pulled away from the container, an individual stick of gum is drawn from the bottom of the stack through the slot.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF THE PREFERRED EMBODIMENT

Figure 1:
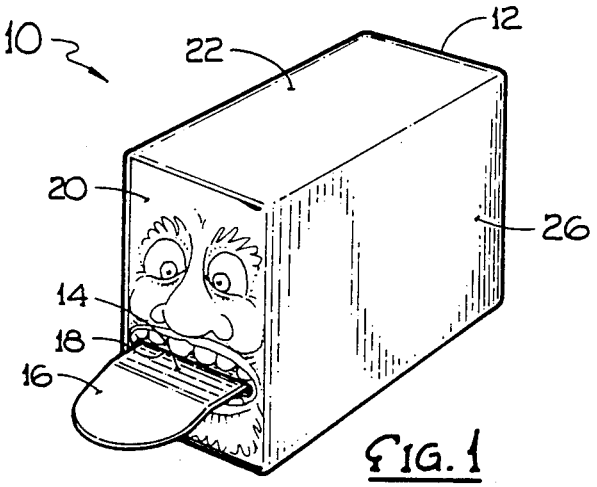
FIG. 1 is a perspective view of the stick gum dispenser.

Referring now to FIG. 1, the stick gum dispenser of the present invention is shown and generally designated 10. As shown, dispenser 10 comprises a container 12 which can be geometrically described as being shaped in the form of a rectangular parallelepiped. Further, dispenser 10 includes a sling 14 which has a continuous flexible body 15 and a free end 16 that extends through the slot 18 located on the lower part of front panel 20. The decorative ornamentation shown on front panel 20 in FIG. 1 has no functional effect for dispenser 10 and may be changed or eliminated depending upon the desires of the manufacturer.

Figure 2:
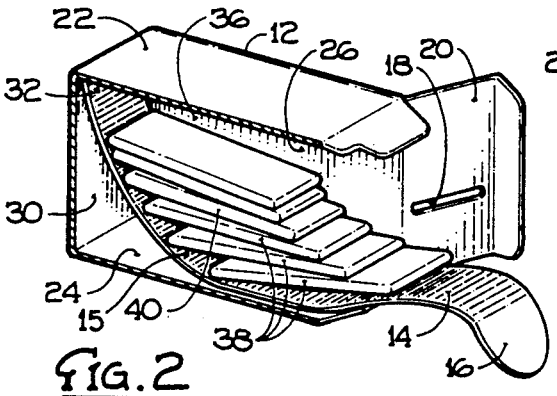
FIG. 2 is a perspective view of the stick gum dispenser with a side panel removed and the front panel opened for clarity.

The construction of dispenser 10 can perhaps be better appreciated by reference to FIG. 2 wherein it is seen that container 12 comprises a top panel 22 which is parallel and opposite to a bottom panel 24. Similarly, a side panel 28 is parallel and opposite to a side panel 26. By cross referencing, it will be appreciated that side panel 28 is removed and not shown in FIG. 2 while side panel 26 is removed and not shown in FIG. 3. The rectangular parallelepiped shape for container 12 is completed by the front panel 20 and a rear panel 30 which are opposite and mutually parallel to each other when they have been closed to configure container 12 as shown in FIG. 1.

Figure 3:
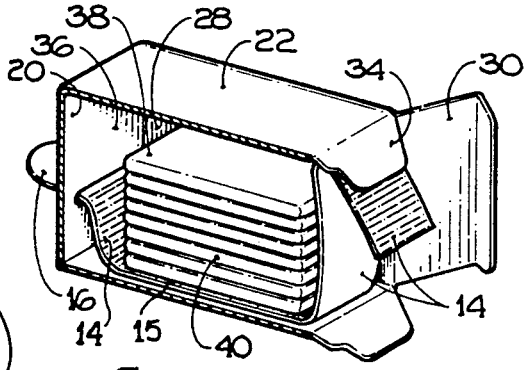
FIG. 3 is a perspective view of the stick gum dispenser with a side panel removed and the rear panel opened for clarity.

FIG. 2 also shows that sling 14 is an elongated substantially rectangular tape-like structure which has a flexible body 15 and an end 32 that is connected to the upper part of rear panel 30. More specifically, as best seen in FIG. 3, sling 14 is attached to a flap 34 which extends from top panel 22 and which, when folded, effectively attaches sling 14 to the juncture between top panel 22 and rear panel 30. Sling 14 can be attached to flap 34 by any means well known in the art such as by gluing.

FIGS. 2 and 3 also show that, within the interior compartment 36 of container 12, a plurality of sticks 38 of wrapped gum can be positioned to form a stack 40. More specifically, the stack 40 is supported on the body 15 of sling 14 and can be moved from the rest position shown in FIG. 3 by the sling 14 within the compartment 36 to draw a stick 38 from the bottom of stack 40 into and partially through the slot 18. As shown, the width of the flexible body 15 of sling 14 is substantially equivalent to the width of the sticks 38. Further, in order to prevent tipping of the sticks 38 within the interior compartment 36, the distance between side panel 26 and side panel 28 is only slightly greater than the width of the sling 14 and the sticks 38.

Figure 4A:
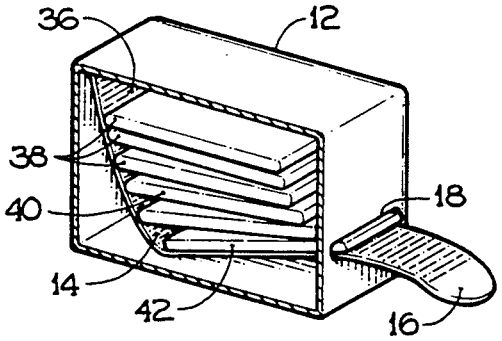
FIGS. 4*a* and 4*b* are perspective views of the stick gum dispenser with a side panel removed for showing sequential steps in the operation of the dispenser.
Figure 4B:
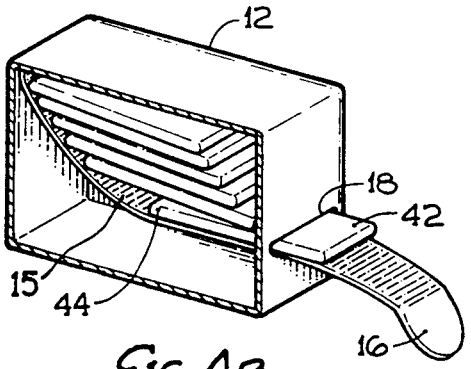

The operation of stick gum dispenser 10 will be best seen by reference to FIGS. 4*a* and 4*b*. In FIG. 4*a*, it can be seen that stack 40 is enclosed inside interior compartment 36 of container 12 with the bottom stick 42 of the sticks 38 having the most direct contact with sling 14. When free end 16 of sling 14 is grasped and pulled away from container 12 into the position shown in FIG. 4*b*, sling 14 urges against end 44 of bottom stick 42 to draw stick 42 partially through slot 18. Bottom stick 42 may itself then be pulled from the container 12. When free end 16 is released, the weight of the gum remaining in the pack will force the flexible body 15 of sling 14 back to the rest position. This action results from the sling being attached to the container at fixed end 32. Similar manipulations of sling 14 can be subsequently accomplished until all sticks 38 in stack 40 have been dispensed.

In accordance with the present invention, and in order to preserve the freshness of gum sticks 38, the individual sticks 38 may be wrapped in a manner well known in the art. Additionally, the entire dispenser 10 and its contents may be wrapped in an air tight envelope (not shown), such as a cellophane wrap, until it is desired to remove gum from dispenser 10. Alternatively, container 12 can itself be sealed in a manner well known in the gum packaging art. Further, in accordance with the present invention, the container 12 is preferably made of SBS board, i.e. solid bleached sulfate. Also, sling 14 is preferably made of a light weight flexible paperboard.

While the particular sling style gum dispenser as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

We claim:

1. A stick gum dispenser which comprises:

a container having a front panel having an upper and lower part and formed with a slot on the lower part thereof and an opposed rear panel having an upper and lower part and disposed substantially parallel to said front panel; and a sling having a fixed end and a free end and a continuous flexible body portion extending between said fixed end and said free end, said body portion dimensioned to support stacked gum sticks thereon and capable of being drawn from a rest position to a dispensing position and returned to said rest position, said free end extending through said slot in said rest position sufficient to grasp and pull said sling to said dispensing position whereby a stick of gum is drawn through said slot, said fixed end joined to said upper part of said rear panel causing said sling to return to said rest position when said free end is not being held.

2. A stick gum dispenser as recited in claim 1 wherein said sling is an elongated substantially rectangular-shaped tape.

3. A stick gum dispenser as recited in claim 2 wherein said container has a pair of substantially parallel opposed side panels connecting said front panel to said rear panel, said side panels being disposed from each other by a distance that is slightly greater than the width of a stick of said gum.

4. A stick gum dispenser as recited in claim 3 wherein said sling is substantially as wide as a stick of said gum.

5. A stick gum dispenser which comprises:

a rectangular-shaped container having a top surface, a front panel having an upper part and a lower part formed with a slot on the lower part of said front panel and connected with said top surface to extend therefrom at a substantially right angle, and a rear panel having an upper portion, said rear panel connected with said top surface to extend therefrom substantially parallel to said front panel; and a sling attached to said upper portion of said rear panel and extending through said slot to support a stack of stick gum and to draw a stick of gum through said slot when said sling is pulled away from said container.

6. A stick gum dispenser as recited in claim 5 wherein said container is made of SBS board.

7. A stick gum dispenser as recited in claim 5 wherein said sling is made of paper.

* * * * *